United States Patent [19]

Purkott

[11] Patent Number: 4,691,617

[45] Date of Patent: Sep. 8, 1987

[54] MULTI-SECTION SWEEP CYCLE COMPACTION CYLINDER

[75] Inventor: Hans D. Purkott, Hot Springs, Ark.

[73] Assignee: Arkansas Precision Hydraulics, Inc., Hot Springs, Ark.

[21] Appl. No.: 829,216

[22] Filed: Feb. 14, 1986

[51] Int. Cl.[4] ..... F15B 11/18; F01B 7/20

[52] U.S. Cl. ..... 91/167 R; 91/525; 91/535; 92/53; 92/66

[58] Field of Search ..... 91/511, 513, 520, 525, 91/534, 535, 167, 168; 92/52, 53, 66, 167

[56] References Cited

U.S. PATENT DOCUMENTS

| | | | |
|---|---|---|---|
| 2,783,744 | 3/1957 | Tennis | 121/46 |
| 2,800,234 | 7/1957 | Herpich et al. | 214/82 |
| 2,933,070 | 4/1960 | Trümper et al. | 92/52 X |
| 3,128,674 | 4/1964 | Ganchar et al. | 91/167 |
| 3,136,221 | 6/1964 | Walker | 91/168 |
| 3,483,798 | 12/1969 | Parrett et al. | 92/52 X |
| 3,610,100 | 10/1971 | Hoffman | 91/167 |
| 3,658,189 | 4/1972 | Brown et al. | 212/55 |
| 3,696,712 | 10/1972 | Sung | 92/52 |
| 3,934,423 | 1/1976 | Haller | 92/52 |
| 4,075,929 | 2/1978 | Peterson | 91/168 |
| 4,191,092 | 3/1980 | Farmer | 91/189 R |

FOREIGN PATENT DOCUMENTS

| | | | |
|---|---|---|---|
| 577947 | 6/1946 | United Kingdom | 92/52 |
| 939849 | 6/1982 | U.S.S.R. | 92/52 |

*Primary Examiner*—Robert E. Garrett

*Assistant Examiner*—Mark A. Williamson

*Attorney, Agent, or Firm*—Stephen D. Carver

[57] ABSTRACT

A triple action, multi-segment, telescoping hydraulic ram comprising a plurality of coaxially nested, extensible cylinders adapted to be selectively extended or retracted, and a pair of lower diameter, sweep cycle cylinders adapted to be operated independently of the larger cylinders. The ram is ideal for the garbage reception area defined within the cargo area of conventional garbage trucks, for operating the compression platen for moving and compacting garbage. A terminal pin eye associated with the smaller sweep cycle cylinder may be coupled to a stationary support to rigidly brace the ram. Full extension and "sweep cycle" operation is effectuated through various input passageways defined in the pin eye through which high pressure hydraulic fluid is inputted to the ram in conjunction with various annular transmittal passageways to effectuate cylinder operation. A plurality of generally coaxial, reduced diameter internal tubes which are concentric with the operable cylinders provide a means of bridging the sweep cycle cylinders to the others. An internal retract tube, a coaxially centered piston center tube, and an internal piston slider tube which floats within the apparatus and communicates between the piston center tube and a spaced apart stationary feeder tube function to effectuate the sweep cycle phenomena of the instant cylinder, and prevent sweep cycle operation during the normal extension cycle.

7 Claims, 10 Drawing Figures

MULTI-SECTION SWEEP CYCLE COMPACTION CYLINDER

BACKGROUND OF THE INVENTION

The present invention relates generally to telescoping, hydraulic power cylinders of the multi-section type. More particularly, the present invention is directed to a multi-section, triple action hydraulic cylinder assembly wherein, at the option of the operator, various smaller diameter internal coaxial tubes may be extended "out of order" in an effort to speed up the necessary sweep cycle.

In the prior art telescoping hydraulic cylinders are well known. A typical prior art hydraulic system comprises a major outer cylinder casing having a plurality of coaxially arranged, internally disposed, properly valved and dimensioned cooperating elements which will controllably extend outwardly of the main body. In normal operation high pressure oil is directed into the casing, and in response thereto, during the extension cycle, the next larger diameter portion of the hydraulic ram will be forced outwardly of the casing so as to effectuate compression. Once the next larger diameter cylinder portion extends outwardly from the base or casing, the end of which is usually fixed, then the next larger rod will extend outwardly, depending upon the hydraulic input controls as selected by the operator.

Thus to effectuate full extension of the cylinder, one must normally wait until the larger diameter cylinders are forced out of the casing, and until each of the progressively smaller diameter cylinders are similarly displaced until full extension is achieved. Normally the process is reversed in the retraction cycle. Conventional operation of such telescoping cylinders thus mandates the pumping of a maximum amount of oil in order to deflect the first stage. If only partial extension of the cylinder is required then it would be desirable to provide a means whereby the lowest diameter internal sections could be first extended, whereby a minimum quantity of oil need be pumped into the cylinder, in order to achieve the benefit of speed.

Such benefits would be particularly advantageous in conjunction with the "sweep cycle" of conventional refuse collection trucks. Such garbage trucks include front loaders which are adapted to be coupled to large metallic conventional cubical refuse containers for overhead dumping. Typical equipment is manufactured by Dempster, E-Z Pack, Hile and other manufacturers. Because the entrance door for dumping the garbage is located on the top of the truck right next to the cabin, once the refuse container is unloaded into the truck the hydraulic cylinder must sweep the garbage away from the initial position immediately below the overhead entrance door to make room for the next input of garbage. This is the so called "sweep" cycle wherein it is necessary to at least partially extend the operative cylinders so as to make room for the next load.

The same cylinder used for this sweep cycle is conventionally employed for the compression stroke, whereupon a platen compresses the load towards the rear exit door of the truck to compact the load during transportation. It is normal that the larger stages move first, and since these stages take the most of hydraulic oil, the time for extending the cylinders during this "sweep" is normally between Thirty Five to Forty Seconds.

It would thus seem desirable to provide a means within a heavy duty, elongated multi-section telescoping hydraulic ram which will facilitate independent selection of smaller internal sections so as to reduce the time for directing hydraulic fluid in the sweep cycle state. In other words, it is advantageous to provide a system wherein the smaller diameter sections of a multi-section, telescoped hydraulic cylinder may be operated independently of the larger diameter sections, while preserving operational integrity and preventing interference with other extension functions. Moreover, trouble free operation within the desired extension and retraction environment is required.

Within the prior art a variety of telescoping hydraulic cylinders are known. For example, attention is directed to U.S. Pat. No. 3,696,712, issued Oct. 10, 1972 which discloses a multi-sectioned hydraulic ram. Similar construction is seen in U.S. Pat. No. 3,934,423, issued Jan. 27, 1976, and U.S. Pat. No. 3,136,221, issued Oct. 27, 1961. An early multi-section hydraulic cylinder including a plurality of coaxially related independently operable elements is seen in U.S. Pat. No. 2,783,744. U.S. Pat. No. 3,610,100 is similar to the latter device.

U.S. Pat. No. 2,800,234 discloses a hydraulic system within the environment of a garbage truck vehicle body for packing refuse loads. The latter patent discusses in detail the particular problems which I have likewise addressed with my present invention. The closest prior art to me comprises U.S. Pat. No. 3,128,674 issued Apr. 14, 1964. In the latter system, however, the "triple action" attributes of the present design are lacking.

Hence I have provided a unique system which may be controlled by the user so as to provide all of the conventional benefits achieved by conventional telescoping multi-sectioned cylinders, while providing the benefits of double action and cooperative integrity of the various cylinders.

Moreover, I have provided an option to independently operate, either through an extension or retraction cycle, the smaller diameter sections of the cylinder in a triple action mode without depressurizing the larger diameter sections of the cylinder. In this fashion many advantages are realized, in that the hydraulic control and valve systems which must be employed to control my invention are simplified, integrity and reliability is increased, and, most importantly, speed in the sweep cycle for conventional refuse compacting and hauling garbage trucks is greatly enhanced.

SUMMARY OF THE INVENTION

A multi-segment sweep cycle hydraulic cylinder including a rigid casing having a plurality of internally coaxially disposed, extensible cylinders adapted to be selectively extended or retracted, and which includes a sweep cycle adaptation whereby the smallest diameter portions thereof may be operationally extended (and retracted) separately from operation of the other larger diameter segments. The cylinder is adapted to be disposed within the interior garbage reception area defined within the cargo area of conventional garbage trucks, for operating the compression platen which is adapted to be forcibly moved towards the rear of the truck during garbage compaction.

For "sweep cycle" purposes, the invention adapts the concept of a telescoping collapsible hydraulic cylinder for independent operation of internal smaller diameter tube sections, independently of operation of the larger diameter sections. This allows incoming trash deposited within the initial cargo reception area to be pushed out of the way of the entry region quite quickly, and for the platen to be immediately thereafter drawn backwards so that the next load may be dumped into the interior.

The outer casing comprises the largest diameter cylinder, and serves as a housing for the rest. Its outer end is coupled to the truck compaction platen. The opposite end of the cylinder comprises a pin eye coupled to the end of the smallest diameter cylinder, which pin eye is permanently pivotally coupled to a stationary support within the cargo area. Full extension of all the cylinders for normal operation, as well as the sweep cycle operation, is effectuated through various input passageways through which high pressure hydraulic fluid is inputted to effectuate operation. A plurality of generally coaxial, internal tubes which are concentric with the operable cylinders provide a means of bridging the sweep cycle cylinders to the others.

The pin eye is coupled to the smallest diameter cylinder, and it secures the outermost smallest diameter cylinder, a cooperating retract tube, and a coaxially centered piston center tube. An internal piston slider tube floats within the apparatus, and communicates between the piston center tube and a spaced apart stationary feeder tube. Control passageways defined through the pin eye and through and about the aforedescribed internal tubes enable the apparatus to be fully extended or retracted, and to extend or retract merely the sweep cylinders (i.e., the two smallest diameter portions) independently of one another and without destructive interference.

Thus a basic object of the present invention is to provide an extensible hydraulic cylinder for refuse trucks which will quickly clear the drop zone within the load compartment so that another load of garbage may be quickly inputted.

A fundamental object of the present invention is to provide a telescoping hydraulic cylinder adapted for use with refuse trucks or the like for speeding up the "sweep cycle" operation thereof.

Another basic object is to provide a high speed, high strength telescoping triple action hydraulic ram having a plurality of cooperating telescopingly arranged sections which, in effect, may be moved by the operator "out of order" relative to the larger diameter sections.

Yet another object of the present invention is to provide a triple action hydraulic cylinder capable of quickly providing sweep cycle operations, while maintaining sufficient integrity and strength to facilitate refuse compression and extraction.

A similar basic object is to provide a composite hydraulic ram of the character described characterized by a plurality of cooperating coaxially aligned telescopingly related sections.

A still further object is to provide a multi-sectioned hydraulic cylinder which may extend and retract in a triple action mode which provides the option of actuating the smaller diameter portions without interference with the larger diameter portions.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
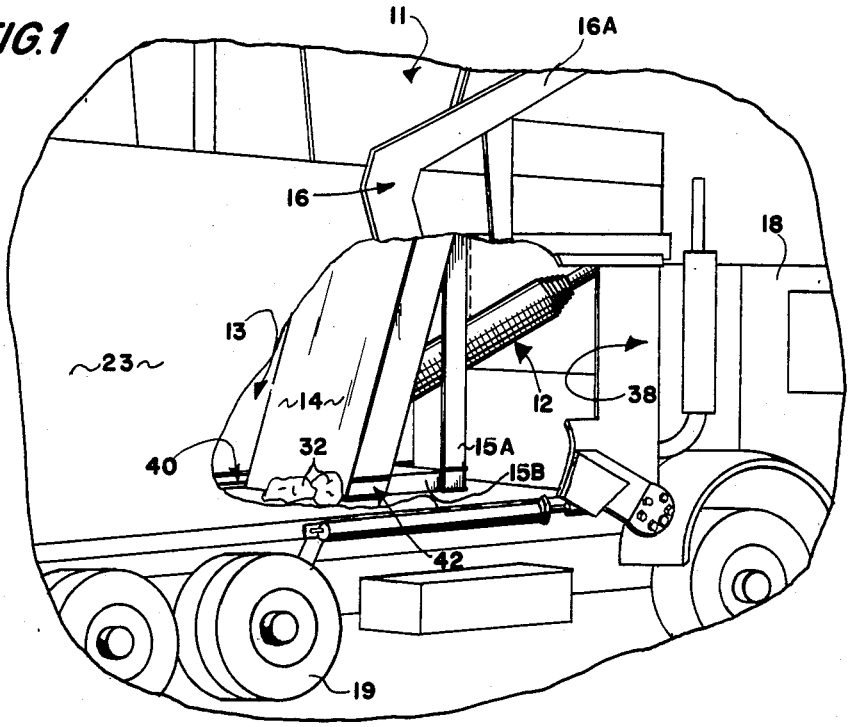
FIG. 1 is a fragmentary, perspective view illustrating placement of the cylinder constructed in accordance with the best mode of the present invention operationally disposed within a conventional overhead loading refuse compacting and hauling truck.
Figure 2:
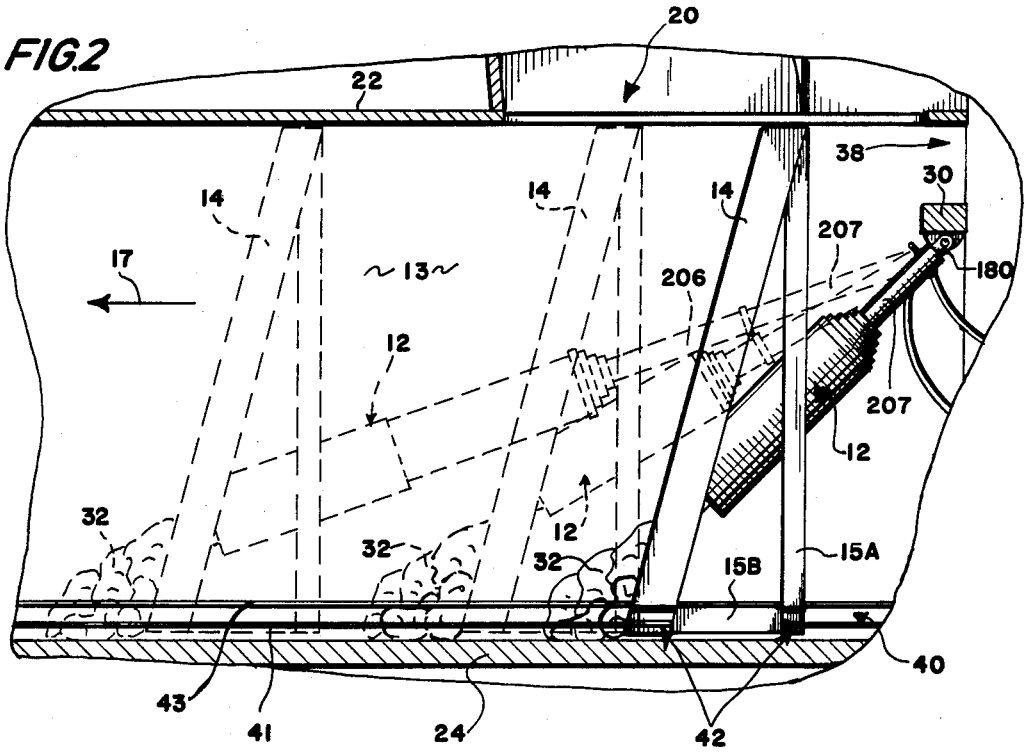
FIG. 2 is an enlarged, fragmentary view of the installed cylinder indicating the Sweep-Cycle movement in dashed lines, the figure having portions thereof omitted for purposes of clarity.

With initial reference now directed to FIGS. 1 and 2 of the appended drawings, a typical overhead loading garbage truck has been broadly designated by the reference number 11. A sweep cycle hydraulic ram or cylinder constructed in accordance with the best mode of the present invention has been generally designated by the reference number 12, and as will be revealed from the drawings, it is disposed operationally within the interior garbage reception area 13 defined between the walls of the truck 11. Within region 13 is disposed a compression board or platen 14 which is adapted to be forcibly moved towards the rear of the truck during compaction by the cylinder 12. In FIG. 2 arrow 17 indicates the general direction of compaction or sweep.

Truck 11 includes a conventional cab 18, conventional wheels 19, a top 22, sides 23, and floor 24, and a conventional overhead loading arm system generally designated by the reference numeral 16. This arm system includes a pair of cooperating, spaced apart fork like arms 16A which are adapted to penetratingly engage suitable channels weldably disposed on opposite sides of the garbage receptacle to be lifted and emptied. It will also be apparent to those skilled in the art that such a receptacle will be rotated above the cargo area 13 of the truck, and turned upside down in response to rotatable maneuvering by the arms 16A so as to dump garbage 32 into the interior 13 of the truck through the open upper portion 20 thereof. Thereafter trash such as trash 32 may be forcibly moved towards the rear of the truck by platen 14.

Platen 14 is reinforced by blade vertical support 15A and lower horizontal support 15B. Platen 14 moves along a track, which has generally be designated by the reference numeral 40. It includes a bottom guide track 41 and an upper track 43 captured within the base struts 42 on opposite sides of supports 15A and 15B.

Figure 3:
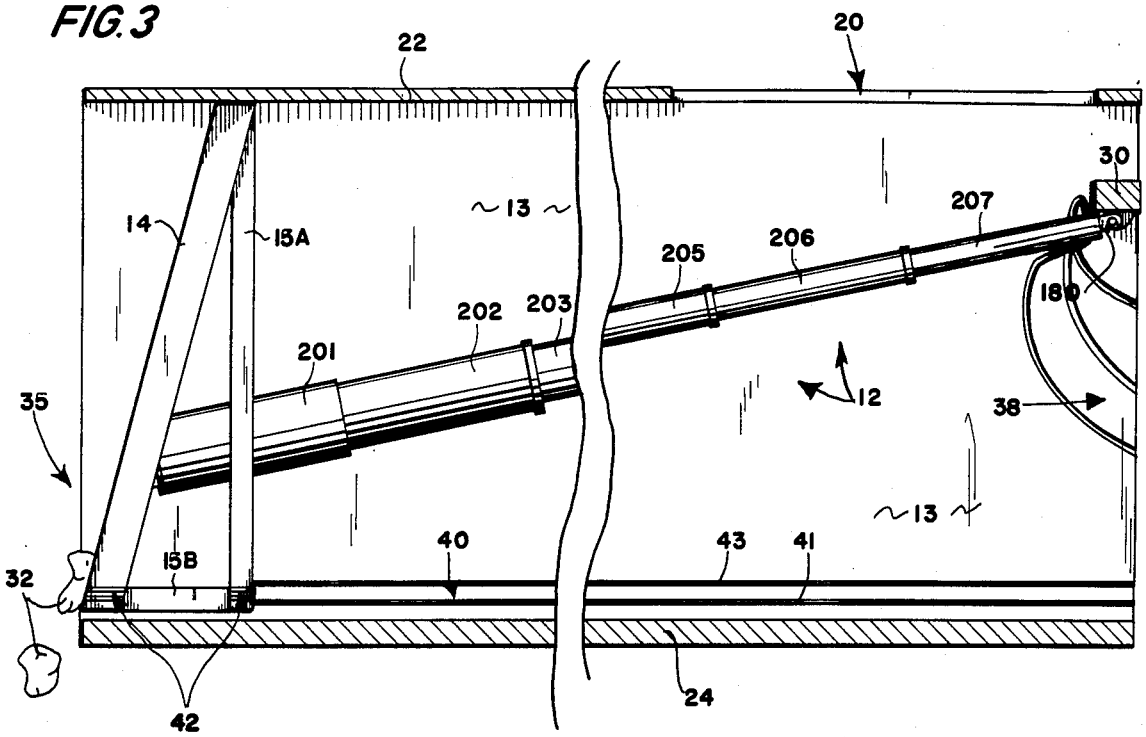
FIG. 3 is a fragmentary sectional view of the fully extended cylinder as it appears in the clean out cycle.
Figure 4:
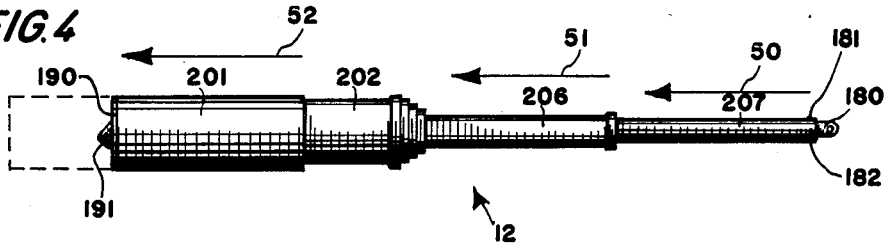
FIG. 4 is a plan view of the cylinder showing the extension stages for the sweep cycle, with arrows indicating the direction of movement during retraction.

With additional reference now directed to FIGS. 3 and 4, the cylinder 12 is operationally pivotally disposed and coupled between an outwardly extending, generally horizontal brace 30 disposed within the cargo interior 13 and the platen 14. When the cylinder elongates as shown generally in FIG. 3, all of the individual sections 201, 202, 203, 204, 205, 206 and 207 will elongate so as to dump trash 32 from the waste gate region 35 (FIG. 3). It will be apparent that during full elongation of the cylinder 12 each of the individual hydraulic cylinder areas must expand, and normally cylinder 202 will first withdraw from base casing 201, followed by the subsequent telescoping emergence of sections 203 through 207.

In order to effectuate a "sweep cycle", the invention adapts the concept of a telescoping collapsible hydraulic cylinder for the independent operation of smaller diameter sections, such as sections 206, and 207, independently of operation of the larger diameter sections. This allows incoming trash within volume area 13 to be pushed out of the way of the upper entry area 20 quite quickly, and for the platen 14 to be drawn backwards so that another load may be dumped into the interior. Since the internal volume of cylinders 206 and 207 is substantially less than the volume of cylinders 201, 202 etc., lesser fluid is required for equal movement thereof.

The lowermost diameter cylinder portion 207 terminates in a suitable pin eye assembly 180 adapted to be pivoted to the mount 30 so as to permanently couple the smaller diameter end of the cylinder 12 within the cargo region 13. The opposite end of the cylinder, which comprises a base end plate 190 (FIG. 4) includes a similar pin eye 191 adapted to be similarly pivotally coupled to the platen assembly 14. In this manner expansion of the cylinder 12 will forcibly move the platen assembly rearwardly, and of course contraction of the cylinder will subsequently draw the platen back towards the front 38 of the truck.

Figure 5:
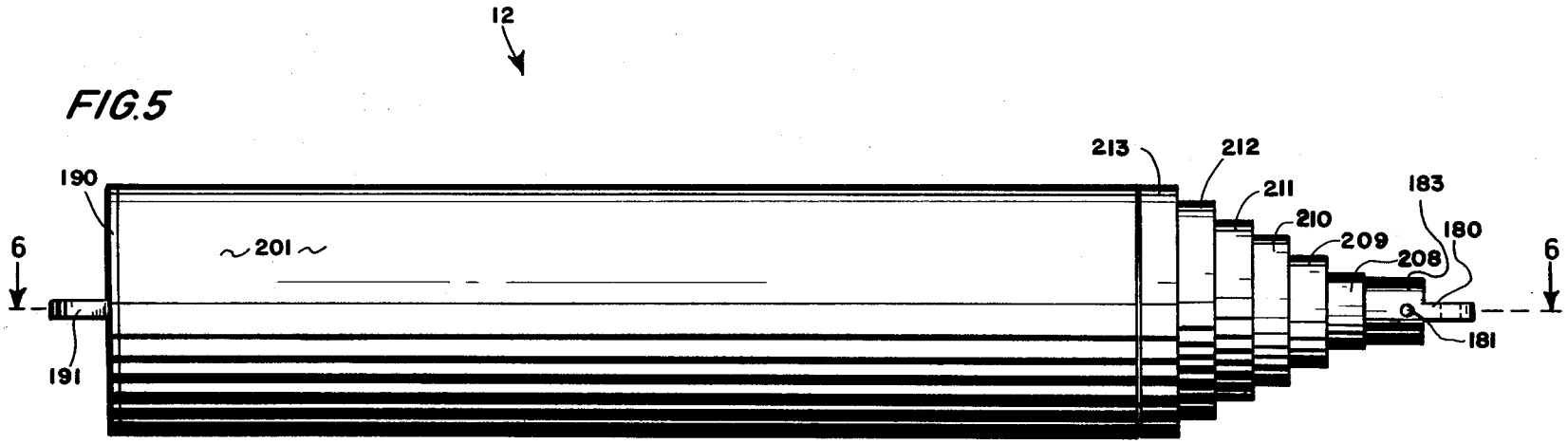
FIG. 5 is an enlarged plan view of a fully retracted cylinder constructed in accordance with the best mode of the present invention.
Figure 6:
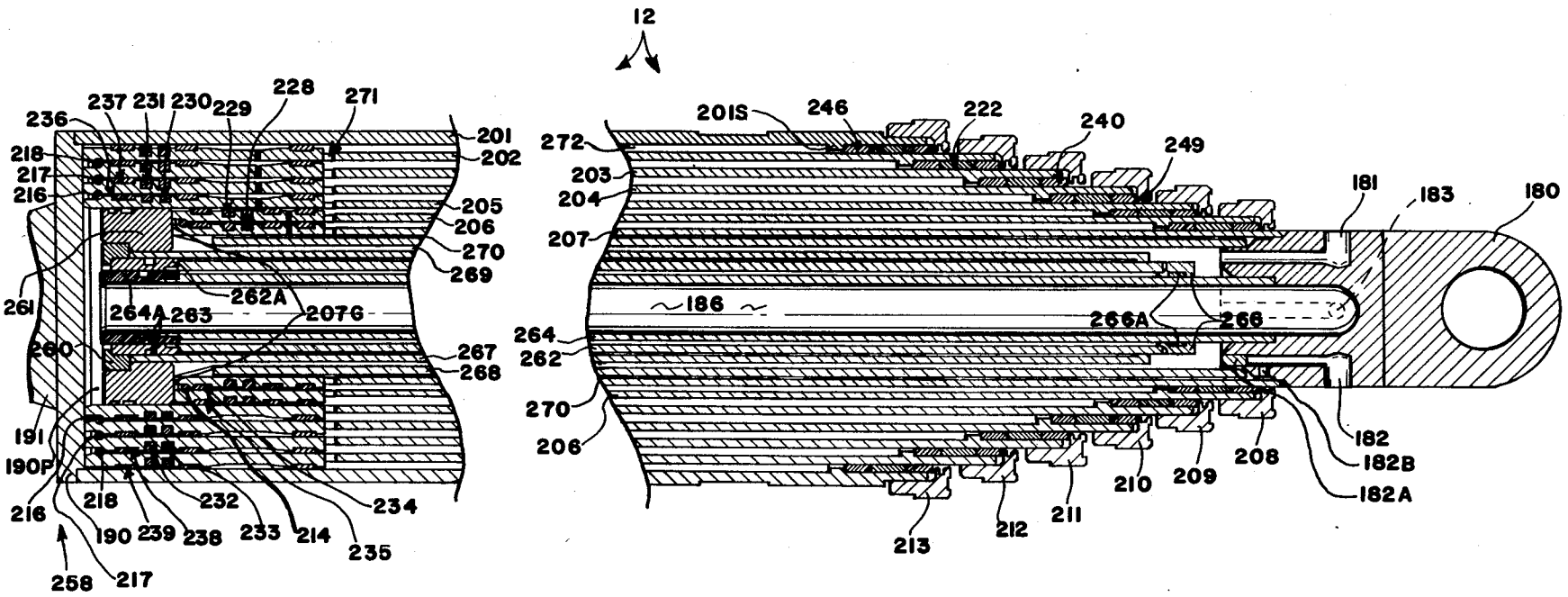
FIG. 6 is an enlarged, fragmentary, sectional view of a fully retracted cylinder taken generally along line 6—6 of FIG. 5.

With reference now additionally directed to FIGS. 5 and 6, the cylinder 12 is thereshown in its retracted or collapsed position. The casing portion 201 of the cylinder is the largest diameter portion, and it serves as a housing for the coaxially disposed smaller diameter cylinders nested therewithin (when the cylinder is in the retracted configuration). It is weldably secured to end cap 190, and its extends concentrically about the other cylinder portions 202, 203, 204, 205, 206, and 207. Each stage terminates in a suitable cartridge nut which separates it mechanically from the next innermost stage. For example base stage 201 terminates in a cartridge nut 213. Stages 202 through 206 terminate in cartridge nuts 212 through 208 respectively. However, the smallest diameter stage 207 terminates in pivot eye assembly 180 to be hereinafter described in detail.

Figure 7:
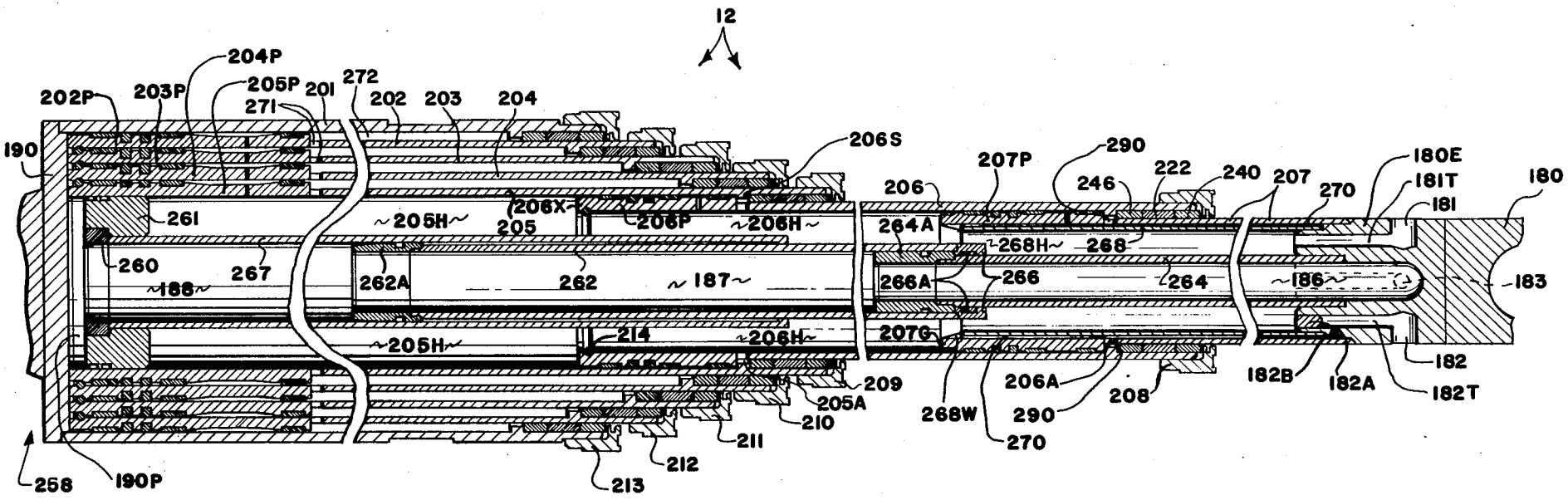
FIG. 7 is an enlarged, fragmentary, sectional view of the slider-tube extension stages of the cylinder effectuating the sweep cycle benefits hereinafter described in detail.
Figure 8:
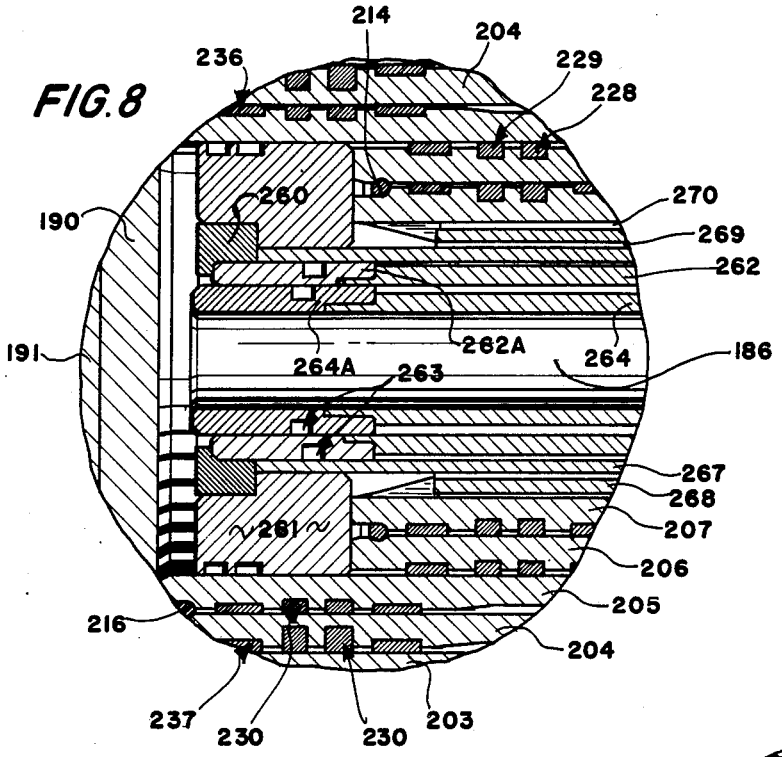
FIG. 8 is an enlarged, fragmentary sectional view of the base and of the slider-tube.
Figure 9:
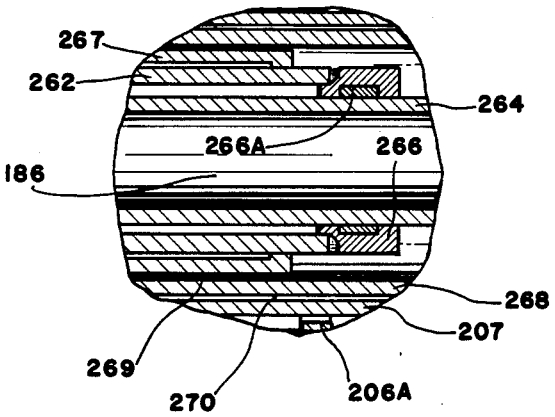
FIG. 9 is an enlarged, fragmentary sectional view of the neck end of the slider tube; and, FIG. 10 is an enlarged, fragmentary sectional view of the oil inlet and retraction ports.

With reference now directed to FIGS. 6 through 10, the concentric stages 201 through 205 are generally conventional, and thus the detailed portions of these stages shown in the left portion of FIG. 6 and FIG. 8 are generally conventional. However, the sweep cycle adaptations to be hereinafter described in detail adapt the cylinder 12 for "quick operation". After extension the cylinder must be returned to the closed position to prevent damage to the cylinder. Fourth stage feed tube 267 is welded into the end block 261 and it terminates in the concentric annular stop ring slider 260. The stop floater 266 is screwed on to the feed tube 264 to prevent the floater tube from being drawn off of the assembly. The floater tube 262 in effect communicates between the fourth stage feed tube and the center feed tube to enable the sweep cycle. As revealed in FIGS. 7 and 10, piston center tube 264 and larger diameter concentric retract tube 268 are stationary relative to each other and to the sweep cycle cylinder 207 in which they are operationally disposed.

The phenomena of telescoping expansion and retraction of multi-section cylinders is generally well known in the art, as discussed earlier. Hence the description of the conventional operating portions of the cylinder 12 has been abbreviated for purposes of brevity. For reference purposes the following table of parts will aide in an understanding of the subsequent discussion herein:

TABLE 1

| Reference Numerals | |
|---|---|
| 201 - Cylinder base body assembly | 202 - First Stage |
| 203 - Second Stage | 204 - Third Stage |
| 205 - Fourth Stage | 206 - Fifth Stage |
| 207 - Sixth Stage | 208 - 5th Carriage Nut |
| 209 - 4th Stage Carriage Nut | 210 - 3rd Carrrage Nut |
| 211 - 2nd Stage Carriage Nut | 212 - 1st Carriage Nut |
| 213 - Body Assembly Carriage Nut | 214 - Fifth Stage Snap Ring |
| 216 - Fourth Stage Snap Ring | 217 - Third Stage Snap Ring |
| 218 - Second Stage Snap Ring | 222 - Rod packing |
| 228 - Piston Ring | 229 - Piston ring |
| 230 - Piston ring | 231 - Piston ring |
| 232 - Piston ring | 233 - Piston ring |
| 234 - 239 Guide Bearings | 240 - Top Bearing |
| 246 - Bearing (bottom) | 249 - Carriage Nut wiper |
| 258 - Base Pit Assembly | 260 - Stop Ring slider |
| 261 - Forth Stage Plug | 262 - Piston Slider tube |
| 262A - Piston Slider tube floater | 263 - Seals |
| 264 - Piston Center Tube | 264A- Piston Cntr. Tube Floater |
| 266 - End Stop Floater | 266A - Bearing |
| 267 - Feed Tube (4th Stage) | 268 - Retract Tube |
| 270 - oil flow channel | 271 - orifices |
| 272 - channel | 290 - Orifices |

Operation

I. Full Extension of all Cylinders

To initialize operations of the full extension cycle, high pressure oil is first inputted to the extension port 183 through a conventional hose fitting, preferably of a 1.25 inch diameter. Port 183 is in fluid flow communication with the interior 186 of the center tube 264, and high pressure fluid reaches the output of the tube 264 at the moving end 258 of the cylinder, escaping into volume 190P immediately to the right (as viewed in FIG. 7) of the end cap 190. Thus a region of pressure is exerted on the inner surface of end cap 190 and the opposite facing surface of the stop ring slider 260 and the concentric stop plug 261, which is permanently screwed to the tube 267.

As will be explained hereinafter in detail, the sweep cycle cylinders 206 and 207 (and the concentric parts interiorly of cylinder 207) are concentrically and slidably disposed within the interior 205H of the least diameter of the non sweep cycle cylinders. Plug 261 seals the oil for the sweep cycle on tubes 206 and 207. When the pressure builds up it deflects end cap 190 to the left (as viewed in FIGS. 6 and 7) exposing the opposite ends of the leftmost (as viewed in FIGS. 6 and 7) ends of the internal cylinders 202, 203, 204, 205, 206, and 207, causing the outermost cylinder casing 201 to appear to move to the left whereupon its packing 222 is drawn over the outer surface of cylinder 202 (toward the left as viewed in FIGS. 6 and 7). It will be noted from the right side (FIG. 6) that outer casing 201 terminates interiorly in an integral concentric stop ring 201S, which defines an oil passageway 272 between its bottom and the outside surface of the next cylinder 202.

Relative axial displacement between casing 201 and the cylinder 202 will occur until stop ring 201S abuts the spaced-apart edge of the annular piston structure 202P associated with cylinder 202. It will also be noted that each of the non sweep cycle cylinders 203, 204, 205, 206, and 207 similarly terminate in annular pistons 203P, 204P, 205P, 206P, and 207P respectively. After the annular stop ring 201S contacts piston 202P limit is stopped, whereupon the next cylinder 202 will move outwardly in response to hydraulic pressure developed interiorly. After relative axial displacement is prevented by contact with stop ring 201S against the piston 202P, increasing hydraulic pressure interiorly of the cylinder will thus force the next succeeding cylinder 202 toward the left (as viewed in FIG. 7) until its similar stop ring 202S will be moved to the left until it contacts forcibly the next succeeding annular piston 203P.

During full extension these cylinders will all axially extend until all of the cylinders have fully extended to a position limited by contact with stop ring 206S with piston 207P. At this time the entire cylinder will be extended, and all of the garbage formerly disposed interiorly of the truck cargo volume 13 will probably have been forced out out of the truck. Of course the cylinder may be installed in a variety of other configurations or devices.

II. Full Retraction

In order to normally retract the fully extended cylinder from the position illustrated in FIG. 3 to that configuration illustrated in FIGS. 5 and 6, port 183 will be opened to the external hydraulic tank and retraction pressure will be provided to port 182. Pressurization of port 182 will transmit hydraulic fluid via passageway 182T and annular region 270 all the way to the left (as viewed in FIGS. 6 and 7) where it will appear to become blocked by chamfered weldment 268W which is at the terminal end of pin eye retraction tube 268. Tube 268 is concentric with closely spaced-apart tube 207 and tube 268 does not move relative to it, since both tubes 268 and 207 are welded to the annular end 180E of pin eye 180. Stop ring 206S will be abutting piston 207P at this time and this will force oil through the first of the retract orifices 271. This causes tube 206 first to withdraw from the coaxially packed assembly, moving to the right (as viewed in FIGS. 6 and 7) relative to the innermost end. At this time the internal pressure is transmitted against bearing 246, packing 222 etc. After the innermost moveable cylinder 207 is thus withdrawn until the innermost edge 207G is restrained by the concentric snap ring 214. The next cylinder 205 will then retract, and it will retract until the threadably captured plug 261 contacts the edge 206X of the next inner cylinder 206. Retraction continues in the order of cylinders 204, 203, 202 until snap rings 216, then 217, and 218 contact the ends of the retracted cylinders as illustrated in FIG. 6.

III. Full extension of the sweep cycle

The sweep cycle is actuated when it is necessary to remove debris from that portion of the vehicle interior 13 immediately below the upper input orifice 20 as that quickly the truck may be adapted for another incoming load. To start the sweep cycle operation it is necessary to appropriately actuate the cylinder elements 206 and 207, which function cooperatively with one another and with the other cylinder elements 201 through 205 previously discussed. The internal passageways to be hereinafter described allow the sweep cycle cylinders to operate separately with one another while also fully extending and retracting in cooperation with cylinders 201 through 205 previously discussed. High pressure oil thus reaches the annular region 268H defined between the retract tube 268 of cylinder portion 207 and the inner piston center tube 264 which is frictionally secured in coaxial relation to plug pin eye 180 in fluid flow communication with the main operating channel 186.

In order to operate the sweep cycle the cylinder must be fully retracted, and the sweep cycle ports 182 and 183 must be open to the return tank. Thus the cylinder must be disposed in the position illustrated in FIG. 6 prior to sweep actuation, and sweep extension cycle operation begins by pressurization of port 181 in the pin eye 180. Pin eye 180 includes three inlet ports. The end stop floater 264A joins inner piston center tube 264 to the cooperating piston slider tube 262. Piston slider tube 262 terminates in piston slider tube floater 262A which is coaxially, sealably, slidably disposed within the interior of fourth stage feed tube 267, which in turn sealably terminates concentrically within the center of the fourth stage plug 261.

Figure 10:
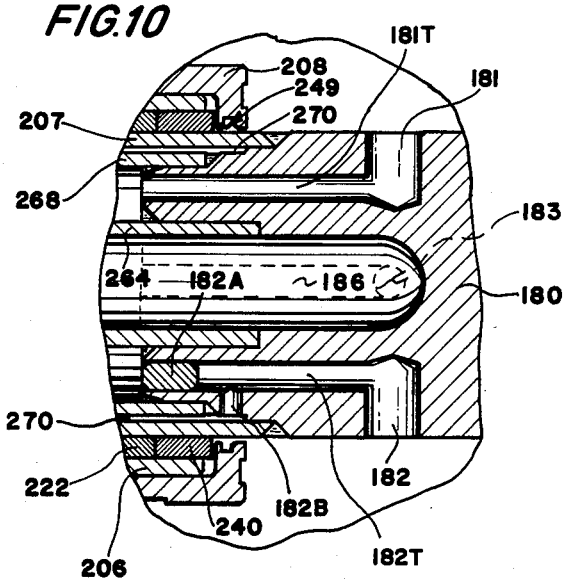

With primary attention now directed to FIGS. 7 and 10, the passageway 181 communicates with the transverse passageway 181T which pressurizes annular volume 268H (defined between tube 268 and 264) and in turn pressurizes the volume 206H and 205H until it contacts the blocking plug 261. This build up of pressure creates internal pressure against plug 261 whereby the concentric mass of cylinders 205, 204, 203, 202, and 201 will appear to move away from the now exposed internal sweep cycle cylinder 206. During this time cylinder 206 will be fully retracted relative to the "stationary" cylinder 207, but the rest of the cylinders will move away from cylinders 206 and 207. This mass of cylinders will continue apparent movement to the left to effectuate the sweep cycle best illustrated in FIG. 2. It will be noted that in the sweep cycle extension phases cylinder 206 will first be exposed, and thereafter the innermost cylinder 207 will be exposed.

Cylinder 206 will now withdraw from the "stationary" cylinder 207 as pressure is confined within volume 205H etc., by limiting provided by plug 261. Thus cylinder 206 will move to the left (as viewed in FIG. 2) exposing cylinder 207 (which is semi-permanently coupled to the truck anchor segment 30 (FIG. 1) with pin eye 180) and relative displacement will occur until piston portion 207P hits the previously discussed internal snap ring 206S to thus limit travel.

IV. Retraction of the Sweep Cycle

To initiate retraction of sweep cycle port 182 is pressurized, and ports 181 and 183 are open to tank. Pressure inputted to port 182 is transmitted through passageway 182T and orifice 182B all the way up to contact with weldment 268W whereupon force developed through drilled orifice 290 (FIG. 7) causes force to develop against the packing bearing 246. Then retraction of the rest of the larger diameter cylinders continues in the same manner as previously described. Thus cylinder 206 will appear to cover cylinder 207 and then all of the other cylinders will move in unison towards the right (as viewed in FIGS. 7 and 2) until retraction is complete.

The floater tube 262 will direct oil to the extension of the total cylinder assembly for the return of the oil and the return cycle of the cylinder. The floater tube 262 in effect bridges between the central tube 264 of 207 and the next cylinder 267 screwed into plug 261 which in effect bridges the sweep cycle components to the larger diameter separate components.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A multi-segment, triple action, telescoping hydraulic ram for selectively actuating a compression platen assembly or the like, said ram comprising:

a first, outermost, largest diameter rigid elongated, cylinder comprising a terminal end cap having an external fitting adapted to be coupled to a first item such as said platen assembly or the like;

a plurality of coaxially disposed, cooperating non sweep cycle cylinders telescopingly disposed internally of said first cylinder, and selectively extensible with respect thereto;

selectively extensible sweep cycle cylinder means comprising a first and a smaller second sweep cycle cylinder operationally disposed coaxially within the smallest one of said last mentioned plurality of non sweep cylinders and adapted to be extended or retracted relative to one another when said non sweep cycle cylinders are in a retracted position, a terminal end of the smallest sweep cycle cylinder terminating in pin eye fitting means for physically anchoring said sweep cycle cylinder means and thus said ram;

end block means secured within said ram and spaced apart from said end cap for internally defining primary pressure chamber means between itself and said endcap;

first fluid input port means for effectuating full extension of said ram by pressurizing said primary pressure chamber means and defined within piston center tube means defined within the smaller diameter sweep cylinder;

second fluid input port means separate from said first fluid input means for effectuating sweep cycle extension of said sweep cycle cylinder means;

third fluid input port means for retracting said ram from the fully extended position or for retracting said sweep cycle cylinders;

bridging tube means operationally extending between said end block means and said sweep cycle cylinder means for hydraulically coupling said plurality of said non sweep cycle cylinders with said sweep cycle cylinders, said bridging tube means comprising:

feed tube means extending coaxially from said end block means toward and coaxially receiving piston slider tube means associated with said sweep cycle cylinders;

said slider tube means extending coaxially between said feed tube means and piston center tube means communicating with said first fluid input port means;

said feed and slider tube means defining a separate sweep cycle actuation chamber between their outer peripheries and said sweep cycle cylinders means;

retract tube means disposed internally of the smallest sweep cycle cylinder for receiving said feed tube means during retraction of said sweep cycle cylinders; and, a sweep cycle retract volume being operationally defined between said retract tube means and said piston center tube means.

2. The ram as defined in claim 1 wherein said retract tube means defines an annular void between itself and the sweep cycle cylinder in which it is disposed in fluid flow communication with said retract port means for distributing fluid interiorly of said sweep cycle cylinders whereby to effectuate retraction of said sweep cycle operation independently of said plurality of non sweep cycle cylinders.

3. The ram as defined in claim 2 wherein said piston center tube means and said retract tube means are stationary relative to each other and relative to the smallest diameter sweep cycle cylinder.

4. A multi-segment, triple action, telescoping hydraulic ram for selectively either fully or partially actuating a device such as a compression platen assembly operatively associated with the garbage receptive cargo area of a conventional garbage truck, said ram comprising:

a first, outermost, largest diameter, rigid elongated, cylinder comprising a terminal end cap having an external fitting adapted to be coupled to said platen within said cargo area;

a plurality of coaxially disposed, cooperating non sweep cycle cylinders telescopingly disposed internally of said first cylinder, and selectively extensible with respect thereto;

selectively extensible sweep cycle cylinder means comprising a first and a smaller second sweep cycle cylinder operationally disposed coaxially within the smallest one of said last mentioned plurality of non sweep cylinders and adapted to be extended or retracted relative to one another when said non sweep cycle cylinders are in a retracted position, a terminal end of the smallest sweep cycle cylinder terminating in pin eye fitting means for physically anchoring said sweep cycle cylinder means and thus said ram within said cargo area;

end block means secured within said ram and spaced apart from said end cap for internally defining primary pressure chamber means between itself and said endcap;

first fluid input port means for effectuating full extension of said ram by pressurizing said primary pressure chamber means and defined within piston center tube means defined within the smaller diameter sweep cylinder;

second fluid input port means separate from said first fluid input means for effectuating sweep cycle extension of said sweep cycle cylinder means;

third fluid input port means for retracting said ram from the fully extended position or for retracting said sweep cycle cylinders;

bridging tube means operationally extending between said end block means and said sweep cycle cylinder means for hydraulically coupling said plurality of said non sweep cycle cylinders with said sweep cycle cylinders, said bridging tube means comprising:

feed tube means extending coaxially from said end block means toward and coaxially receiving piston slider tube means associated with said sweep cycle cylinders;

said slider tube means extending coaxially between said feed tube means and piston center tube means communicating with said first fluid input port means;

said feed and slider tube means defining a separate sweep cycle actuation chamber between their outer peripheries and said sweep cycle cylinder means; and, retract tube means disposed internally of the smallest sweep cycle cylinder for receiving said feed tube means during retraction of said sweep cycle cylinders; and, a sweep cycle retract volume being operationally defined between said retract tube means and said piston center tube means.

5. The ram as defined in claim 4 wherein said retract tube means defines an annular void between itself and the sweep cycle cylinder in which it is disposed in fluid flow communication with said retract port means for distributing fluid interiorly of said sweep cycle cylinders whereby to effectuate retraction of said sweep cycle operation independently of said plurality of non sweep cycle cylinders.

6. The ram as defined in claim 5 wherein said piston center tube means and said retract tube means are stationary relative to each other and relative to the smallest diameter sweep cycle cylinder.

7. A telescoping hydraulic ram for selectively either fully or partially actuating a device such as a compression platen assembly operatively associated with the garbage receptive cargo area of a conventional garbage truck, said ram comprising:

a first, outermost, largest diameter rigid elongated, cylinder comprising a terminal end cap having an external fitting adapted to be coupled to said platen within said cargo area;

a plurality of coaxially disposed, cooperating non sweep cycle cylinders telescopingly disposed internally of said first cylinder, and selectively extensible with respect thereto;

selectively extensible sweep cycle cylinder means comprising a plurality of separate cooperating sweep cycle cylinders operationally disposed coaxially within the smallest one of said last mentioned plurality of non sweep cylinders and adapted to be extended or retracted relative to one another when said non sweep cycle cylinders are in a retracted position, a terminal end of the smallest sweep cycle cylinder terminating in pin eye fitting means for physically anchoring said sweep cycle cylinder means and thus said ram;

end block means secured within said ram and spaced apart from said end cap for internally defining primary pressure chamber means between itself and said endcap;

first fluid input port means for effectuating full extension of said ram by pressurizing said primary pressure chamber means and defined within piston center tube means defined within the smaller diameter sweep cylinder;

second fluid input port means separate from said first fluid input means for effectuating sweep cycle extension of said sweep cycle cylinder means;

third fluid input port means for retracting said ram from the fully extended position or for retracting said sweep cycle cylinders;

bridging tube means operationally extending between said end block means and said sweep cycle cylinder means for hydraulically coupling said plurality of said non sweep cycle cylinders with said sweep cycle cylinders, said bridging tube means comprising:

feed tube means extending coaxially from said end block means toward and coaxially receiving piston slider tube means associated with said sweep cycle cylinders;

said slider tube means extending coaxially between said feed tube means and piston center tube means communicating with said first fluid input port means;

said feed and slider tube means defining a separate sweep cycle actuation chamber between their outer peripheries and said sweep cycle cylinder means;

retract tube means disposed internally of the smallest sweep cycle cylinder for receiving said feed tube means during retraction of said sweep cycle cylinders; said retract tube means defining an annular void between itself and the sweep cycle cylinder in which it is disposed in fluid flow communication with said retract port means for distributing fluid interiorly of said sweep cycle cylinders whereby to effectuate retraction of said sweep cycle operation independently of said plurality of non sweep cycle cylinders; and, wherein said piston center tube means and said retract tube means are stationary relative to each other and relative to the smallest diameter sweep cycle cylinder; and, a sweep cycle retract volume being operationally defined between said retract tube means and said piston center tube means.

* * * * *